United States Patent [19]

Griffin

[11] Patent Number: 4,463,586

[45] Date of Patent: Aug. 7, 1984

[54] AUTO WRAP ANGLE/POSITIONER FOR SHAPE SENSING ROLL

[75] Inventor: Alan O. Griffin, Richmond, Va.

[73] Assignee: Reycan Research Limited, Rexdale, Canada

[21] Appl. No.: 484,466

[22] Filed: Apr. 13, 1983

[51] Int. Cl.[3] ..... B21B 37/04; B21C 47/00

[52] U.S. Cl. ..... 72/17; 72/146; 242/67.1 R

[58] Field of Search ..... 72/17, 146, 148; 364/472; 73/159; 242/57, 67.1 R

[56] References Cited

U.S. PATENT DOCUMENTS

| | | | |
|---|---|---|---|
| 3,334,508 | 8/1967 | Martin | 72/364 |
| 4,199,117 | 4/1980 | Muller et al. | 242/75.2 |
| 4,232,540 | 11/1980 | Cain et al. | 72/17 |
| 4,339,934 | 7/1982 | Mitchell | 72/17 |
| 4,343,440 | 8/1982 | Engl | 242/67.2 |

*Primary Examiner*—Lowell A. Larson
*Assistant Examiner*—Jorji M. Griffin
*Attorney, Agent, or Firm*—Schwartz, Jeffery, Schwaab, Mack, Blumenthal & Koch

[57] ABSTRACT

The invention relates to an improvement in a metal strip rolling apparatus. The metal strip rolling apparatus consists of a rolling mill, a tension take-up reel to receive the metal strip passing through the mill, and a shape sensing roll mounted between the mill and the take-up reel. The shape sensing roll provides information for adjusting the mill for correction of the shape of the metal strip in the mill. The improvement consists of a closed loop system for automatically adjusting actual wrap angle of the metal strip on the shape sensing roll. The closed loop includes hydraulic lifts, disposed at either end of the shape sensing roll, for adjusting the position of both ends of the shape sensing roll simultaneously relative to the position of the take-up reel. A servo actuator controls the operation of the hydraulic lift. An electronic processor receives information from the shape sensing roll relating to its actual wrap angle, and it has in its memory a quantity indicative of a desired wrap angle. Thus, when actual wrap angle is different from desired wrap angle, the processor will actuate the servo to control the hydraulic lift to adjust the position of the shape sensing roll to eliminate the difference.

15 Claims, 2 Drawing Figures

AUTO WRAP ANGLE/POSITIONER FOR SHAPE SENSING ROLL

BACKGROUND OF INVENTION

1. Field of the Invention

The invention relates to a system for automatically positioning the shape sensing roll of a metal strip rolling mill so as to maintain the proper wrap angle of the metal strip on the shape sensing roll. More specifically, the invention relates to such a system which includes a processor means for determining the appropriate wrap angle of the metal strip on the shape sensing roll, and hydraulic means for positioning the shape sensing roll, the hydraulic means being under the control of a servo means which receives actuating inputs from said processor means.

2. Description of Prior Art

In metal strip rolling mills, in order to determine whether the metal strip has the proper shape parameters such as gauge, level, bend, flatness, etc., the metal strip is led over a shape sensing roll where the parameters are measured, whereby to provide information for adjusting the mill for correction of the shape of the metal strip. The shape sensing roll typically comprises a plurality of side-by-side sensors as illustrated, for example, in U.S. Pat. No. 3,334,508, Martin, Aug. 8, 1967.

An important consideration in a system such as illustrated in the Martin patent is the wrap angle of the metal strip on the shape sensing roll. The wrap angle is defined as the angle subtended at the center of the shape sensing roll between the two points at which the metal strip is tangent to the shape sensing roll. If the wrap angle is too small, then the metal strip will not exert enough pressure on the shape sensing roll for the sensors to detect the pressure so that the shape sensing roll will not be able to perform its control function. If the wrap angle is too large, then the metal strip will exert enough pressure to do permanent damage to the sensors of the shape sensing rolls as the sensors are relatively fragile instruments.

As illustrated in U.S. Pat. No. 4,339,934, Mitchell, July 20, 1982, of which the present invention is an improvement, the wrap angle on the shape sensing roll 24 will change as a greater amount of strip is wrapped on the tension take-up reel 28. As can be seen, when there is only a small amount of metal strip coiled on the take-up reel, then the wrap angle on 24 is relatively large. However, as the amount of the coiled metal strip increases, the wrap angle decreases. Accordingly, it is possible to go from an appropriate size wrap angle to a wrap angle size which is too small.

One of the solutions of the prior art is to vertically position the shape sensing roll, relative to the position of the take-up reel, in a compromise manner, i.e., so that the range of wrap angles from start to finish is adequate, but only for a very small period of this time is the size of the wrap angle at its optimum. The positioning of the shape sensing roll is accomplished with a mechanism which includes side plates, with precisely located notches, on either side of the shape roll. The mechanism is rigidly fixed in position as it is necessary to ensure that the shape sensing roll remains horizontal at all times. If the shape sensing roll strays from the horizontal, then the measurements it records will not be accurate.

A problem with this approach is that it does represent a compromise solution instead of an optimum one. In addition, the vertical positions which the shape sensing roll can occupy are predetermined and cannot easily be altered. If the compromise lies somewhere between these discrete predetermined positions, then the compromise will not even be an optimum compromise.

A far better solution to the problem is the one illustrated in the Mitchell patent. Specifically, the Mitchell patent employs a hold-down roll 30 which is downstream of the shape sensing roll 24. As can be seen in the single drawing of the Mitchell patent, although the wrap angle on the hold-down roll will change as the coil of metal strip on the take-up reel increases, the wrap angle on the shape sensing roll will remain constant, this angle being fixed by the position of the hold-down roll 30 relative to the position of the shape sensing roll 24.

While the Mitchell solution does constitute an excellent response to the problem, there is one difficulty that the Mitchell solution does not overcome. Specifically, it is well known in the art that the appropriate wrap angle is a function of the gauge of the strip and the tension on the strip between the mill and the take-up reel. As these factors will vary from run to run, it is desirable to have a system whereby the wrap angle of the metal strip on the shape sensing roll can be varied. As it appears that the position of the hold-down roll in Mitchell is fixed in its operating condition, variation of the wrap angle would not be possible in the patented system.

In addition, the Mitchell solution requires the addition of a further roll, namely, the hold-down roll. As all rolls contacting the sheet have the ability to cause marks at one time or another, the addition of a further roll constitutes a disadvantage. Further, the additional roll will make system alignment more difficult.

In accordance with the present invention, the wrap angle will be made variable by providing means for continuously changing the vertical position of the shape sensing roll. The positioning means comprise hydraulic means, on either side of the shape sensing roll, under the control of MOOG servo position actuators which are accurate to within 0.005 in. That is, the height at either end of the shape sensing roll will be within 0.005 in. of the height of the other end, so that the roll remains substantially horizontal.

Means for altering the position of rolls in rolling mills are well known. The discrete position mechanical means as above described is one of these apparatus. A further apparatus is illustrated in U.S. Pat. No. 4,232,540, Cain et al, Nov. 11, 1980. The Cain et al patent teaches a hydraulic means 52, under the control of a servo valve 58, for altering the position of bending roll 16. However, the roll positioning means of Cain et al operate in an open loop system, and it does not operate on the shape sensing roll whose requirements are far different from the requirements of the bending roll.

SUMMARY OF INVENTION

It is therefore an object of the invention to overcome the disadvantages as above-described of the prior art.

It is a more specific object of the invention to provide a system for automatically and continuously positioning the shape sensing roll of a metal strip rolling mill.

It is an even more specific object of the invention to provide such a system which includes a processor means for determining the appropriate wrap angle of a metal strip on the shape sensing roll, and hydraulic means for positioning the shape sensing roll, the hydraulic means being under the control of a servo means which receives actuating inputs from said processor means.

In accordance with a particular embodiment of the invention there is provided an improvement in a metal strip rolling apparatus which apparatus consists of a rolling mill, a tension take-up reel to receive the metal strip passing through the mill, and a shape sensing roll mounted between the mill and the take-up reel, the shape sensing roll providing information for adjusting the mill for correction of the shape of the metal strip in the mill. In accordance with the invention, the improvement comprises means for automatically adjusting actual wrap angle of the metal strip on the shape sensing roll. The means for automatically adjusting includes hydraulic means disposed at both ends of the shape sensing roll for adjusting the position of both ends of the shape sensing roll simultaneously relative to the position of the take-up reel. Servo means control the operation of the hydraulic means, and processor means receive information from the shape sensing roll relating to the actual wrap angle and including in its memory a quantity indicative of a desired wrap angle. The shape sensing roll and the hydraulic lift and the servo means and the processor means comprise a closed loop. Whereby, when the actual wrap angle is different from the desired wrap angle, the processor will actuate the servo to control the hydraulic lift to adjust the position of the shape sensing roll to eliminate the difference.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
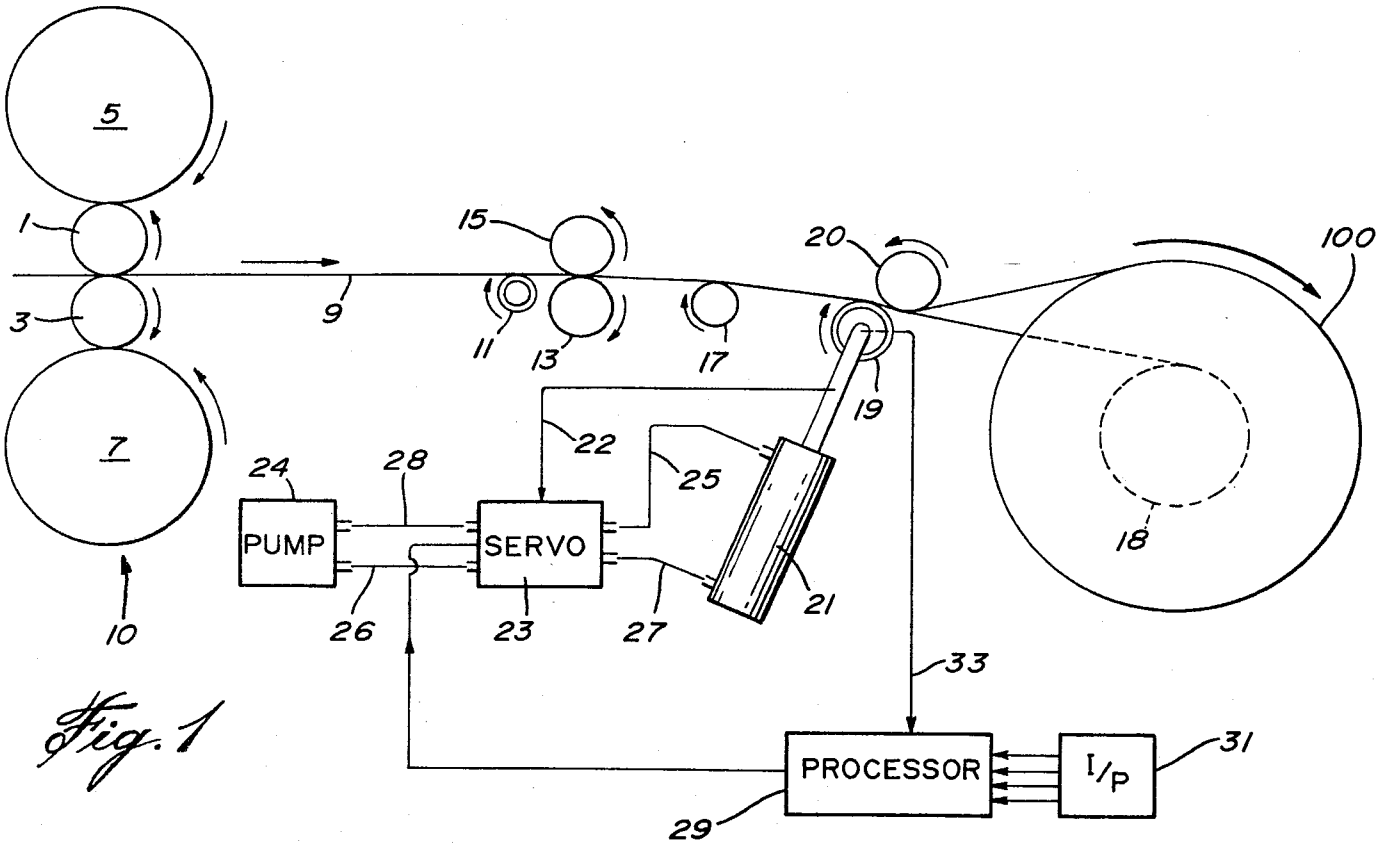
FIG. 1 is a schematic diagram of the side view of the rolling mill in accordance with the invention.

Referring now to the drawings, there is shown a rolling mill having a pair of work rolls 1,3, between back-up rolls 5 and 7. A metal strip 9, such as an aluminum strip, is, as well known in the art, reduced in gauge as it passes through the work rolls. The strip 9 may now pass over an idler supporting roll 11 and between a pair of edge trimming rolls 13 and 15. A further supporting roll 17 may be provided downstream of the trimning rolls.

The rolls 11 to 17 illustrate a typical configuration but do not constitute a part of the present invention.

The strip 9 is then passed over the shape sensing roll 19. In accordance with one embodiment of the invention, a hold-down roll 20 is also provided. However, as will be discussed below, in accordance with another embodiment of the invention, the hold-down roll 20 is not included.

The metal strip is then wound in a coil 100 around tension take-up reel 101 which is in a fixed position.

Figure 2:
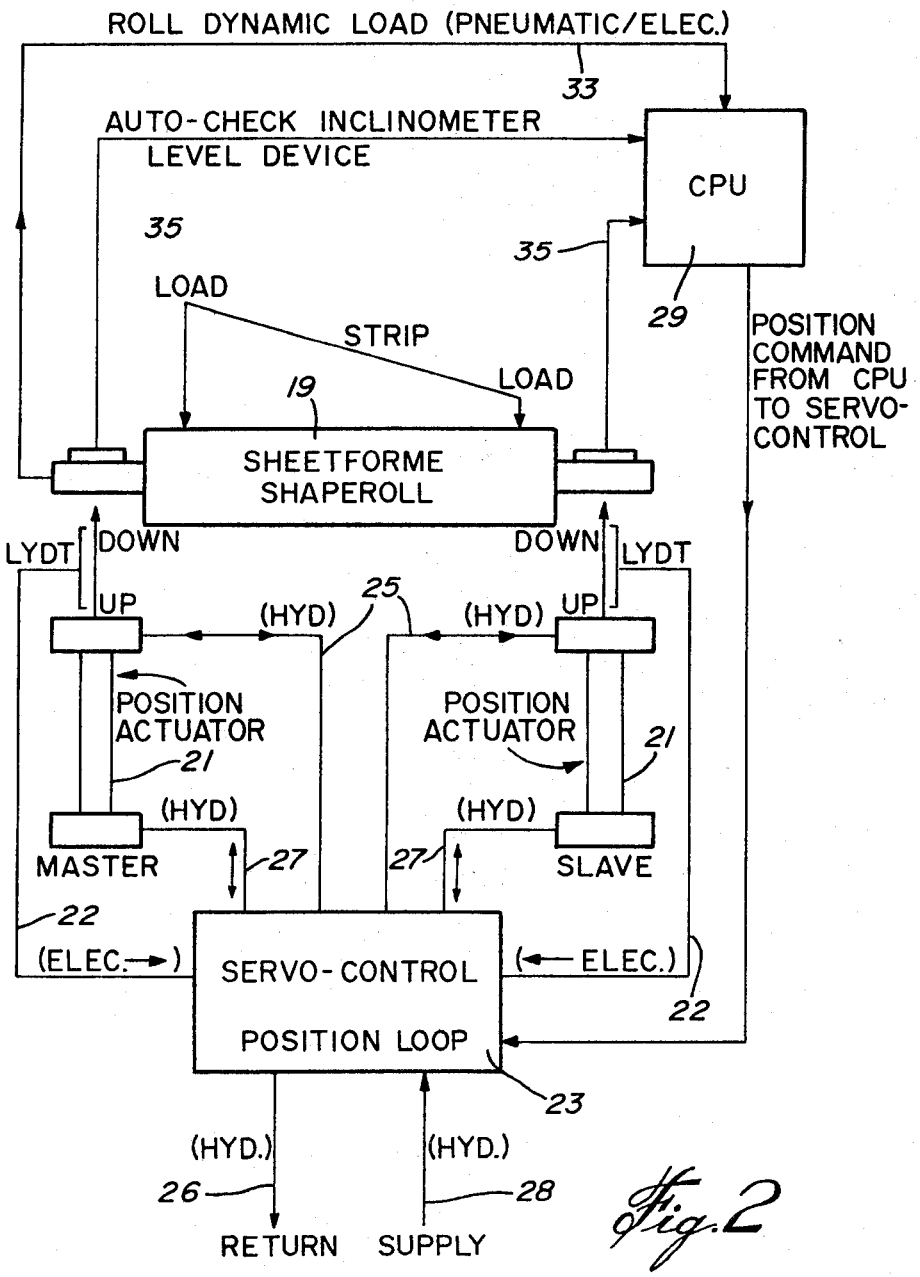
FIG. 2 is a schematic diagram of the inventive system in block diagram form.

Turning now to the system for automatically and continuously positioning the shape sensing roll, relative to the take-up reel, to sustain an appropriate wrap angle of the metal strip 9 on the shape sensing roll, the system includes hydraulic lift means, illustrated as a piston and cylinder means 21, disposed at both ends of the shape sensing roll (as shown in FIG. 2) to simultaneously adjust the position of both ends thereof. The hydraulic lift means is driven by servo actuator 23 which, as above-mentioned, preferably comprises a MOOG servo position actuator. Hoses 25 and 27 are provided for feeding fluid to the lift 21 and returning fluid from the lift 21 respectively, and hoses 26 and 28 are connected to pump 24 for pumping fluid into or out of the hydraulic lift through the servo 23. Feedback means 22 provide the servo actuator 23 with an indication of the position of the hydraulic lift, and this indication is compared with an indication of the required position to thereby either actuate or turn off the servo 23.

The system also includes a processor 29 which has input means 31 such as a keyboard or the like.

The average pressure reading on the shape sensing roll is fed to the processor 29 via conductor 33.

In operation, the system works as follows:

Data concerning the determining parameters, for example, the characteristics of the metal of the metal roll, the gauge of the metal roll, take-up reel tension, etc., are fed to the processor through the input 31. On the basis of these parameters, the processor will determine the amount of pressure that the strip should be exerting on the shape sensing roll, or, what is analagous, the wrap angle of the metal strip on the shape sensing roll, and, therefore, the position of the shape sensing roll relative to the take-up reel. In the embodiment where there is no hold-down roll, the shape sensing roll will be positioned appropriately at the start of coiling. Specifically, enough pressure will be exerted by the metal strip to ensure that measurements are accurate. However, the pressure will be kept low enough so that no damage will be done to the shape sensing roll.

After coiling has begun, pressure measurements will continuously be fed to the processor. When the wrap angle gets small enough, because the size of the coil 100 has grown large enough, then the pressure will decrease, and the processor will signal the servo to actuate the hydraulic lift to lift the shape sensing roll so as to increase the actual wrap angle so that it corresponds to the calculated wrap angle, i.e., it eliminates the difference between the desired and actual wrap angles. (Of course, the actual variable measured and compared will be pressure). In this respect, acceptable pressure is not a single pressure but rather a range of pressures. Accordingly, the hydraulic lift will not be moving continuously as the coil gets larger but will rather remain in the same position until the coil is expanded to such a degree that the pressure is reduced outside of the acceptable range of pressures. Only when the pressure of the strip on the shape sensing roll is outside of this range of pressures will compensating positioning take place.

However, the range of pressures in accordance with the invention will be a relatively small range and is by no stretch of the imagination similar to the compromise range of the prior art as discussed in the preamble herein. This small range is possible because of the fact that it is now feasible to reposition the shape sensing roll even as the coiling of the metal strip is taking place. The re-positioning of the shape sensing roll is possible only in a close looped system as described herein.

In the embodiment where a hold-down roll is used, there is no need for the re-positioning of the shape sensing roll during the coiling process. With such an embodiment, the parameters are fed into the processor which determines the required position of the shape sensing roll relative to the hold-down roll. The relative position of the hold-down roll is also fed into the processor or constitutes a permanent part of the processor. As above-mentioned, with the hold-down roll, the size of the coil 100 is no longer relevant as the wrap angle on the shape sensing roll will remain the same throughout the entire coiling process because the wrap angle is determined by the position of the hold-down roll relative to the shape sensing roll. Nevertheless, even in this embodiment, the closed loop system provides advantages in that the best wrap angle, rather than a compromise wrap angle, can be selected and maintained due to the continuous movement of the shape sensing roll. The continuous movement is possible because of the feedback arrangements in the closed loop system.

It can be seen that the closed loop positioning system herein both overcomes the disadvantages of the prior art and provides substantial advantages relative thereto.

Although a particular embodiment has been described, this was for the purpose of illustrating, but not limiting, the invention. Various modifications, which will come readily to the mind of one skilled in the art, are within the scope of the application as defined in the appended claims.

I claim:

1. In a metal strip rolling apparatus consisting of a rolling mill, a tension take-up reel to receive the metal strip passing through the mill, and a shape sensing roll mounted between the mill and the take-up reel, the shape sensing roll providing information for adjusting the mill for correction of the shape of the metal strip in the mill, the improvement comprising:

means for automatically adjusting actual wrap angle of the metal strip on the shape sensing roll, said means for automatically adjusting com- prising:, hydraulic means, disposed at both ends of the shape sensing roll, for adjusting the position of both ends of the shape sensing roll simultaneously relative to the position of said take-up reel;

servo means for controlling the operation of said hydraulic means; and processor means receiving information from said shape sensing roll relating to said actual wrap angle and including in its memory a quantity indicative of a desired wrap angle;

said shape sensing roll and said hydraulic lift and said servo means and said processor means comprising a closed loop:

whereby, when said actual wrap angle is different from said desired wrap angle, said processor will actuate said servo to control the hydraulic means to adjust the position of the shape sensing roll to eliminate said difference.

2. The improvement as defined in claim 1 wherein said servo means comprises a MOOG servo position actuator.

3. The improvement as defined in claim 1 and further comprising feedback means between said hydraulic lift and said servo to indicate the position of said hydraulic lift to said servo.

4. The improvement as defined in claim 1 and further comprising input means to said processor for inserting parameters of said metal strip and said metal strip rolling apparatus.

5. The improvement as defined in claim 1 wherein said information from said shape sensing roll comprises pressure of said metal strip on said shape sensing roll sensed by said shape sensing roll.

6. The improvement as defined in claim 5 wherein said shape sensing roll comprises a plurality of side-by-side sensing elements, said pressure comprising the average pressure of said elements.

7. The improvement as defined in claim 1 wherein said hydraulic lift comprises a piston and cylinder arrangement.

8. In a metal strip rolling apparatus consisting of a rolling mill, a tension take-up reel to receive the metal strip passing through the mill, and a shape sensing roll mounted between the mill and the take-up reel, the shape sensing roll providing information for adjusting the mill for correction of the shape of the metal strip in the mill, the improvement comprising:

means between said shape sensing roll and said take-up reel for maintaining a constant wrap angle of said metal strip on said shape sensing roll;

means for automatically adjusting actual wrap angle of the metal strip on the shape sensing roll, said means for automatically adjusting comprising:

hydraulic means, disposed at both ends of the shape sensing roll, for adjusting the position of both ends of the shape sensing roll simultaneously relative to the position of said take-up reel;

servo means for controlling the operation of said hydraulic means; and processor means receiving information from said shape sensing roll relating to said actual wrap angle and including in its memory a quantity indicative of a desired wrap angle;

said shape sensing roll and said hydraulic lift and said servo means and said processor means comprising closed loop;

whereby, when said actual wrap angle is different from said desired wrap angle, said processor will actuate said servo to control the hydraulic means to adjust the position of the shape sensing roll to eliminate said difference.

9. The improvement as defined in claim 8 wherein said means for maintaining said constant angle comprises a hold-down roll.

10. The improvement as defined in claim 8 wherein said servo means comprises a MOOG servo position actuator.

11. The improvement as defined in claim 8 and further comprising feedback means between said hydraulic lift and said servo to indicate the position of said hydraulic lift to said servo.

12. The improvement as defined in claim 8 and further comprising input means to said processor for inserting parameters of said metal strip and said metal strip rolling apparatus.

13. The improvement as defined in claim 8 wherein said information from said shape sensing roll comprises pressure of said metal strip on said shape sensing roll sensed by said shape sensing roll.

14. The improvement as defined in claim 13 wherein said shape sensing roll comprises a plurality of side-by-side sensing elements, said pressure comprising the average pressure of said elements.

15. The improvement as defined in claim 8 wherein said hydraulic lift comprises a piston and cylinder arrangement.

* * * * *